US005346082A

United States Patent [19]

Ochs et al.

[11] Patent Number: 5,346,082

[45] Date of Patent: Sep. 13, 1994

[54] COMPOSITE CLOSURE WITH SEALING FORCE INDICATING MEANS AND RATCHET OPERATED TAMPER INDICATING BAND

[75] Inventors: Charles S. Ochs; James D. Haaser, both of Lancaster, Ohio

[73] Assignee: Anchor Hocking Packaging Co., Lancaster, Ohio

[21] Appl. No.: 71,764

[22] Filed: Jun. 9, 1993

Related U.S. Application Data

[63] Continuation-in-part of Ser. No. 897,786, Jun. 12, 1992, abandoned.

[51] Int. Cl.[5] ..... B65D 41/34

[52] U.S. Cl. ..... 215/252; 215/276; 215/350

[58] Field of Search ..... 215/252, 274, 276, 349, 215/350, 351

[56] References Cited

U.S. PATENT DOCUMENTS

| | | | |
|---|---|---|---|
| 1,740,881 | 12/1929 | Taliaferro . | |
| 2,144,287 | 1/1939 | Enkur | 215/276 |
| 3,930,589 | 1/1976 | Koontz . | |
| 4,093,094 | 6/1978 | Smalley et al. | 215/276 |
| 4,289,248 | 9/1981 | Lynn | 215/331 X |
| 4,402,418 | 9/1983 | Ostrowsky | 215/252 |
| 4,609,115 | 9/1986 | Moore et al. | 215/252 |
| 4,694,969 | 9/1987 | Granat | 215/252 |
| 4,694,970 | 9/1987 | Hayes | 215/252 |
| 4,801,029 | 1/1989 | Begley | 215/250 |
| 4,809,858 | 3/1989 | Ochs | 215/276 |
| 4,813,561 | 3/1989 | Ochs . | |
| 4,875,594 | 10/1989 | Ochs | 215/252 |
| 4,880,127 | 11/1989 | Doi | 215/276 X |
| 4,981,230 | 1/1991 | Marshall et al. | 215/252 |
| 5,009,324 | 4/1991 | Ochs . | |
| 5,027,964 | 7/1991 | Banich, Sr. | 215/252 |
| 5,031,787 | 7/1991 | Ochs | 215/276 |
| 5,040,692 | 8/1991 | Julian | 215/258 |
| 5,062,538 | 11/1991 | Ochs | 215/260 |
| 5,078,290 | 1/1992 | Ochs | 215/276 |

FOREIGN PATENT DOCUMENTS 1165726 6/1988 European Pat. Off. .

*Primary Examiner*—Allan N. Shoap
*Assistant Examiner*—Vanessa Caretto
*Attorney, Agent, or Firm*—Wood, Herron & Evans

[57] ABSTRACT

A composite closure for a container has an outer ring with a half-toroidal lip which overhangs a bead around the periphery of an insert cover disk. As the closure is tightened on the container the lip bears downwardly on the bead of the disk and urges the disk against the container rim. Reaction force uncoils the lip like a watch spring, and a visible gap develops between the inner edge of the lip and the disk. This gap provides a visible on-line indicator that the lip is exerting sealing force on the disk. In a second aspect of the invention, a tamper-evidencing band on the closure has ratchets which engage angularly spaced groups of ratchets on the container. Unequal torque thereby acts on bridges which connect the tamper evidencing band to the closure, causing the bridges to break sequentially rather than simultaneously. As a result the bridges can be made stronger and premature breaking is reduced.

28 Claims, 2 Drawing Sheets

COMPOSITE CLOSURE WITH SEALING FORCE INDICATING MEANS AND RATCHET OPERATED TAMPER INDICATING BAND

RELATED APPLICATION

This application is a continuation-in-part of the copending application of Charles S. Ochs, Ser. No. 07/897,786, filed Jun. 12, 1992, now abandoned.

BACKGROUND OF THE INVENTION

This invention relates to a closure for sealing a food container. More particularly, it relates in one aspect to a composite closure having visual sealing force indicating means, and in another aspect to a closure having a ratchet operated tamper indicating band.

Composite closures are widely used to seal food containers, for example wide mouth containers which are "retorted" after sealing. Such closures comprise a sealing disk or cover, usually of metal or alternatively plastic, which is encircled and housed within a separately formed molded plastic ring or shell. The disk has a raised peripheral bead which presents a downwardly opening groove that contains a sealant or gasket for forming a seal with a sealing rim around the top or finish of the container. The ring holds the disk down on the container but is rotatable relative to the disk so as not to turn the disk on the container, which would greatly increase the torque required for opening or closing. This type of seal is relatively insensitive to the thermal expansion and contraction that occur during retorting. (In retorting, after the container has been filled it is heated to a temperature above about 220° F. under external pressure to sterilize the food sealed in it.)

The Prior Art

Ochs U.S. Pat. No. 4,813,561, issued Mar. 21, 1989, shows a composite retortable closure having a metal disk with a raised peripheral bead. The bead presents a downwardly opening groove that contains a sealant or gasket material for making a seal with the top, outer, and/or inward surface of the rim of the container. The disk is rotatably housed within an encircling molded plastic ring having an inwardly projecting curved lip which extends to and engages the top of the bead of the disk. Cooperating securing means such as threads or lugs enable the ring to be tightened on the container. As the ring is tightened, the undersurface of the lip bears downwardly on the disk bead thereby forcing the sealant material into sealing engagement with the container rim. The patent also describes a tamper indicating band around the lower edge of the shell. The band is connected to the shell by a line of weakness provided by a series of small frangible bridges, and includes an upwardly and inwardly projecting band retainer. Interengaging ratchet teeth are provided on the container and the inwardly facing surface of the retainer. When the closure is first opened, the interengaging ratchet teeth prevent the retainer from turning with the rest of the closure, which in turn causes the tamper evidencing band to break off along the line of weakness. The band then drops downwardly, thereby indicating at least partial opening.

The Problem In The Art

Certain problems have arisen in respect to the closure shown in Pat. No. 4,813,561. First, when the closure is being tightened to seal the container, it is sometimes difficult to tell quickly and visually whether the ring has been turned sufficiently far to supply the necessary hold down force on the disk to form a seal between the disk and the container rim. The application torque, that is, the circumferential twisting force applied to the closure, is not necessarily a good measure of the downward force being exerted; the two forces are directed in planes which are perpendicular to one another, and torque can be misleadingly affected by friction between the relatively moving surfaces resulting from dimensional variations, tolerances, temperature, lubricity, and distortion of the plastic when the cap is applied hot in a steam atmosphere. While the sufficiency of sealing can of course be checked by off-line tests, it has been desirable to have an on-line, easily ascertainable visual indicator that can be observed on the filled containers as they pass on the sealing line.

Moreover, during retorting water collects in the interthread space around the threads of the container and closure. It is very difficult to remove or dry water in the interthread space because that space is essentially closed at the top by the shell lip, which tightly engages the disk bead and prevents drying air from flowing past the lip and through the interthread space. Thus there has been a need for a means of drying the interthread space, after the closure has sealed the container.

Further, it has been necessary to make each individual frangible bridge relatively weak so that the total torque required for breaking the bridges is not excessive for weaker, handicapped users. However, because the individual bridges are purposely made weak, they tend undesirably to break prematurely during closure shipping, feeding or application. Thus it has been desirable to provide a tamper indicating band having bridges strong enough to resist premature breaking yet which are not so strong as to impede closure opening.

Still further, the ratchets by which the tamper indicating band retainer engages the container do not lock it against rotation as securely as would be desired. The ratchets are formed on spring-like "fingers" which project upwardly and inwardly from the band retainer (if the ratchets were formed as a continuous hoop, the hoop would be too stiff to be inverted from a down "as molded" position to an up, "use" position). However, the fingers have a tendency to twist sideways or cock and slip without holding, and thereby sometimes permit the closure to be turned without breaking the bridges as quickly as desired. Thus it has been desirable to provide a ratchet operated band retainer wherein the ratchets on the closure do not slip past the ratchets on the container.

Brief Description of the Invention

It has been an object of this invention to provide an improved composite closure which provides a visual indicator that the closure ring is applying sufficient downward force to the disk to effect sealing with the container.

It has been a further object of the invention to provide a tamper evidencing band construction whereby the individual bridges can be made sufficiently strong to prevent premature fracture but which will still break without excessive total removal torque.

A further object of the invention has been to provide a ratchet operated tamper evidencing band wherein the ratchets are less likely to strip when the closure is opened.

It has been a further object of the invention to provide a composite closure whereby water in the interthread space can be dried or blown out with an air jet after sealing.

In accordance with a first aspect of this invention, the composite closure has a metal cover or disk inserted in an encircling molded plastic ring. The disk has a raised annular bead around its outer edge, and the bead presents a downwardly opening groove containing a sealant or gasket which forms a seal with the rim of a container. The plastic ring has an inwardly extending half toroidal semi-circular sectioned annular lip which engages the disk bead to exert downward force on the bead at the time of sealing the container. The lip curves semicircularly downwardly and inwardly to a lower inner edge which is radially inward of the bead. This inner edge bears on or is close to a lower central surface of the disk inwardly of the bead. As the ring is tightened on a container the lip applies force downwardly on the bead of the disk. Rather than acting as a C-clamp on the bead, however, the lip is yieldable and bends gradually upwardly, like a watch spring. The force it exerts on the disk is relatively insensitive to tightening torque. The flexion of the lip moves its inner edge upwardly, thereby spacing it from, or farther from, the disk top so that a bandlike annular gap appears (or widens) between the lip inner edge and the disk surface. It has been found that the presence, or increased width, of this gap can provide a reliable visible indicator that the lip is exerting a pre-established downward sealing force on the disk. In sealing the closure, rather than applying torque up to a specific maximum value, torque is increased until a lip edge-to-disk gap appears. The degree of ring rotation is preferably limited by the provision of one or more stops on the cooperating threads or other securing elements between the closure and container which fix the relative angular position to which the closure can be tightened. After the assembled container and closure have "aged" for a few days and the normal plastic creep or relaxation have occurred, this construction provides a known and reliable removal torque.

In order to permit blowout or removal of residual water trapped in the interthread space, air channels are preferably provided, extending between the ring lip and the bead and continuing past the outer edge of the disk into the interthread space. These channels may be provided as gaps or grooves between downwardly extending bosses or ribs on the underside of the lip. Regardless of the downward force applied by the lip to the bead, these channels provide small but effective paths which lead into the interthread space and provide an entrance and path for air so that water can be blown off the disk and out of the interthread space. If a ratcheted tamper evidencing band is included, as is preferred, an outlet through it can be provided by spaces between the ratchet fingers.

In another aspect of the invention, the "weak bridge" problem is overcome by providing a ratchet structure whereby the bridges are caused to break sequentially in small groups, rather than all at the same time. The opening torque is concentrated on only a few bridges at a time, rather than on all, as a result of which the applied force per bridge is greater. This in turn enables all the bridges to be made stronger, with the result that the problem of premature breaking can be overcome. To achieve this the ratchet teeth on the container are formed in sets which are spaced apart by angularly wide gaps, rather than being provided around the entire periphery of the container. On the closure, the ratchet teeth may be spaced uniformly around the band retainer, but they do not engage any opposing ratchets on the container in the spaces between the container ratchet sets. It has been found that when this closure is twisted to remove it, the retainer in portions opposite these spaces distorts inwardly toward the container wall, into the spaces between the sets of container ratchets. Surprisingly, this distortion concentrates the strain on a smaller number, less than all, of the bridges so that the bridges break sequentially in small groups around the band, rather than all simultaneously. The ratchets on the container may be arranged in two diametrically opposed spaced apart sets, or in three spaced sets in a triangular arrangement, but four spaced sets seem to work best. The sets should be spaced preferably by at least about 35°. The number of sets of ratchets is not as important as the provision of gaps between the sets which gaps are sufficiently wide in angular extent that the closure retainer distorts inwardly into those gaps upon initial opening. Even a very small degree of radial distortion is sufficient. This distortion changes the shape of the retainer from generally circular to a relatively polygonal or distorted shape, for example toward a rounded triangle or square in which stress is concentrated at the corners. This concentrated stress first breaks those individual bridges which are located nearest the container ratchets; breakage then proceeds across the remaining bridges of the ring. Because of this non-simultaneous breakage, the bridges can be made somewhat stronger so that they do not break so readily when shipping, feeding, or sealing the closures.

Because some ratchets on the retainer are not engaged with container ratchets, the closure ratchets which are engaged tend to tilt or tip sideways and bend or break, and thereby lose their grip on the container. This would permit closure rotation without breaking the bridges. However, it has been found that this problem can be overcome by connecting some (not all) of the ratchets on the retainer with flexible webs or connectors so that the connected ratchets brace one another and are more resistant to bending sideways.

DESCRIPTION OF THE DRAWINGS

The invention can best be further described by reference to the accompanying drawings, in which.

DETAILED DESCRIPTION

Figure 1:
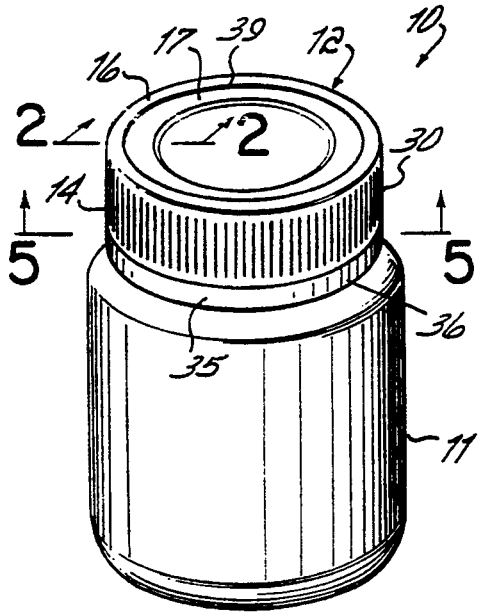
FIG. 1 is a perspective view of a sealed package in accordance with the invention.

FIG. 1 shows a sealed package 10 which comprises a container 11 in the form of a wide mouth jar, and a closure 12. The closure comprises a molded plastic annular ring or shell 14 and a cover or insert disk 17 which is received in shell 14 below an inwardly projecting lip 16 of the shell. The disk is preferably axially movable within the ring, being retained from below by an inwardly projecting boss or rib 26 (FIGS. 2 and 3) on the ring.

Figure 4:
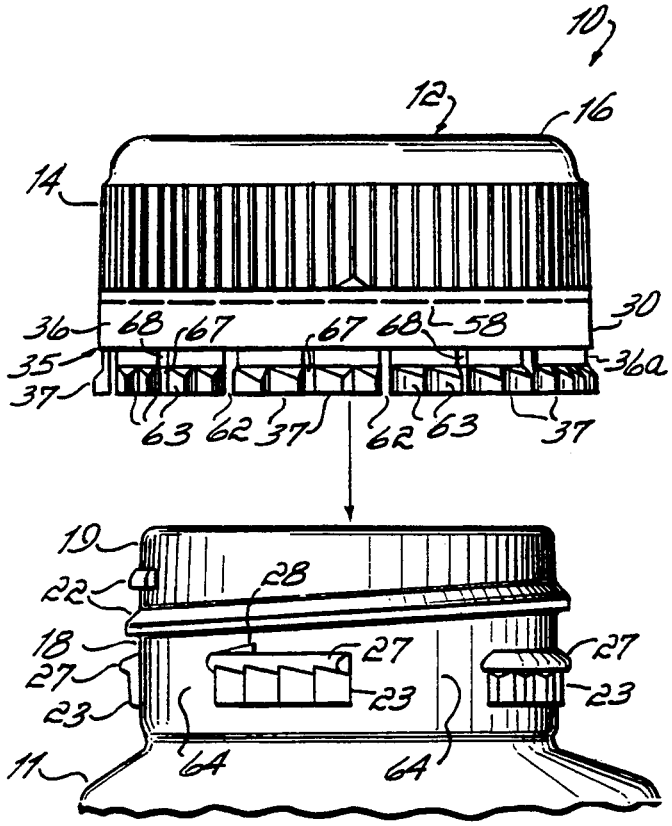
FIG. 4 is a side elevation, partly broken away, of the closure and the top portion of the container.
Figure 2:
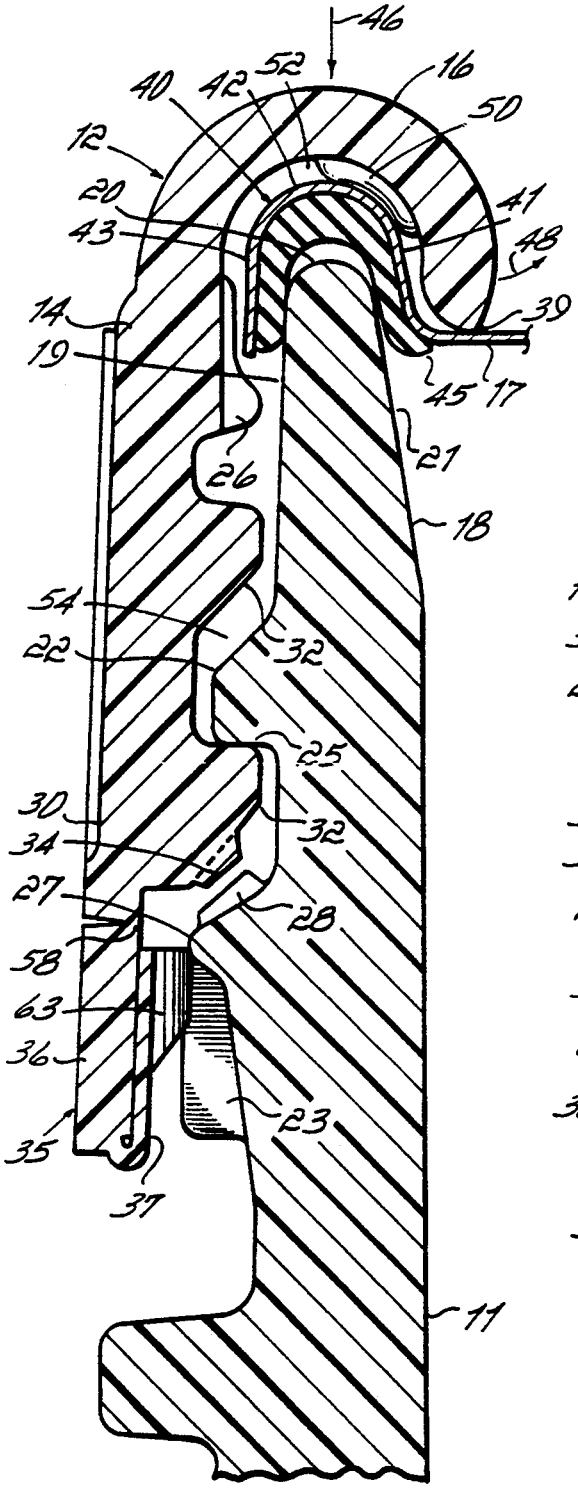
FIG. 2 is an enlarged section taken on line 2—2 of FIG. 1, but shows the closure as it is being tightened on the container.
Figure 3:
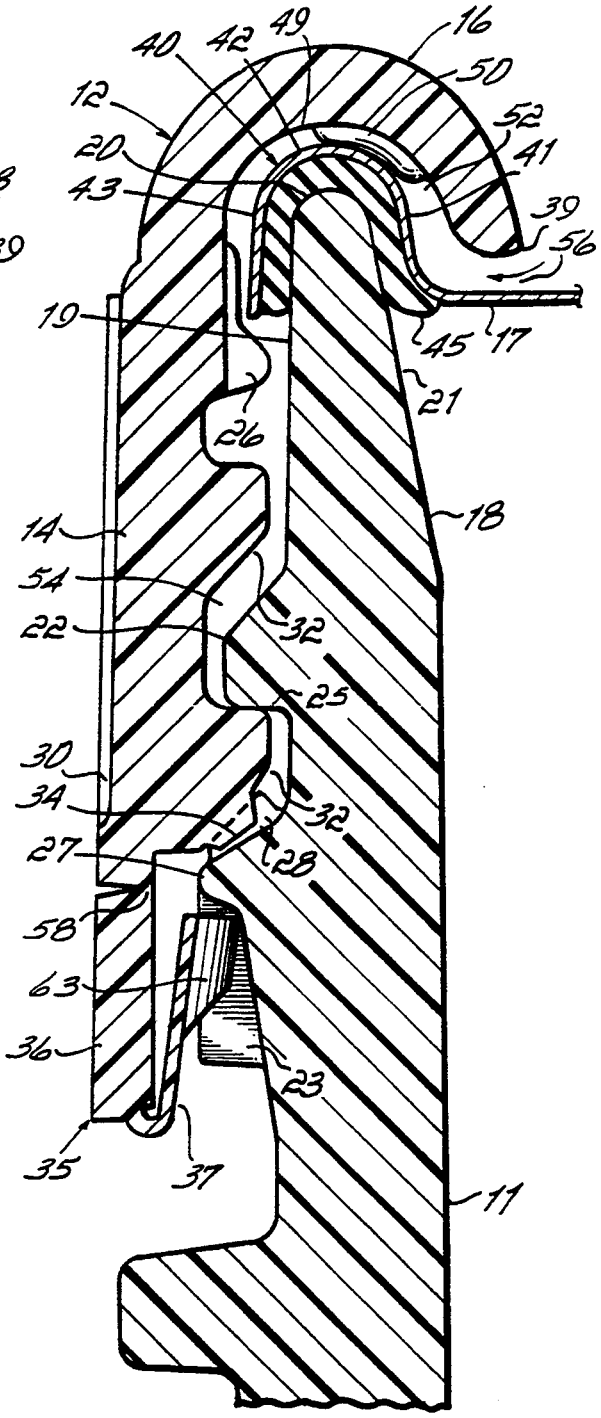
FIG. 3 is a sectional view similar to FIG. 2 but shows the closure fully tightened on the container with the indicator gap being visible.

As shown in FIGS. 2 and 3, container 11 is typically blow molded in plastic and is an integral one-piece body. It has a finish 18, securing means 22 on its outer surface, and several spaced sets of ratchets 23 below the securing means. The container finish 18 is tapered in vertical cross section, having an outer surface 19, a rounded rim 20 and an inner surface 21. In the embodiment shown the securing means 22 is a single continuous thread, but the invention also contemplates the use of lugs or of multiple threads. The thread of securing means 22 preferably has a flat lower surface 25. Below securing means 22 and immediately above each set of ratchets 23 is a segmented ratchet cam 27 (FIG. 4). Cams 27 assist the engagement and seating of the closure ratchet fingers in the container sets of ratchets. Once seated, the fingers need not interengage thereafer with the cams; the function of the cams 27 is not to prevent vertical motion of the retainer during closure removal, but rather to initially seat the ratchets so that they do not thereafter rotate. On its upper surface one cam 27 presents an upstanding stop or boss 28 which engages a cooperating stop on the closure in order to limit rotation of the closure on the securing means 22, as will be described.

Shell 14 of closure 12 includes a skirt 30 on the inside surface of which are securing means 32, shaped to coact with the cooperating securing means 22 of the container (see FIG. 3). On its outside surface skirt 30 may have gripping means such as ribs 34 or knurling. Adjacent its lower end, closure thread 32 has a stop 34 which, as the closure is tightened, comes rotationally into abutment with stop 28 on the container to limit further rotation. Optionally but preferably, the closure has tamper-evidencing means 35 in the form of detachable band 36 and, hinged to the band along its lower edge, a series of upwardly and inwardly projecting ratchet fingers or tabs 37.

At the top of shell 14, lip 16 curves inwardly, then downwardly, having a C-shaped or approximately semicircular or half toroidal vertical section (see FIG. 2). Lip 16 curves inwardly to a lower edge 39. When the closure is tightened on the container this lip 16 exerts downward force on a raised peripheral bead 40 on disk 17. The bead 40 has an upstanding inside wall 41, a curved top 42, and a downwardly curving outside wall 43, and thereby presents a downwardly opening channel. A flexible seal or gasket 45, for example a conventional plastisol, is deposited in the bead channel. Either as formed or as used, gasket 45 conforms to the outer sealing surface 19, rim 20, and/or the inner sealing surface 21 of the closure finish (see FIG. 3) for forming a seal therewith.

In order to make the seal between the disk gasket and the container, a downward force is applied to the top 42 of bead 40, as indicated by the arrow 46 in FIG. 2. Engagement of the lip 16 with the bead top 42 applies a downward sealing force as the closure is tightened on the container.

Where it is desired to provide an on-line indication that sealing force is being applied to the closure, disk 17 should be made of metal or other rigid material so that it is sufficiently rigid not to be deformed by the force but will rather compress the gasket 45. In contrast, lip 16 of the plastic ring is yieldable and is configured so that it "uncoils" or "unwinds" outwardly, like a watch spring, as it is pressed downwardly against the bead. As this occurs lip lower edge 39 is moved inwardly and upwardly, as indicated by arrow 48 in FIG. 2. The lip is not rigid and does not clamp the metal bead like a C-clamp; rather it simply presses the bead downwardly and itself visibly deforms.

As shown in FIG. 2, lip 16 may but need not necessarily have a substantially uniform wall thickness over its semicircular annular section. Preferably, however, a series of angularly spaced, downwardly extending ribs 50 are provided at the top or apex 49 of its downwardly facing surface. These ribs axially engage the top 42 of the bead near or at the top to exert the downward pressure on the bead. The spaces between the ribs 50 provide channels 52 for the flow of wash water or drying air under lip 16, over bead 40, downwardly past bead outer wall 43, and into the interthread space 54 around the securing means 22, 32. The flow can exit from the lower end of the interthread space between tamper evidencing means 35 and the container finish.

When the closure is tightened on the container, lip 16 exerts downward force on the bead 40, pushing it downwardly against the container rim 20 and wedging the gasket against the outside and/or inside rim surfaces 19, 21, respectively (see FIG. 3). The bead 40 exerts an equal and opposite upward reaction force on lip 16 (through ribs 50, if present), and causes the lip to unwind and tend to straighten. As this occurs, the vertical distance or gap height between the lower edge 39 of lip 16 and disk 17 increases (compare FIGS. 2 and 3). This annular gap or space 56 provides an indication that the lip is being deflected and therefore that the lip is exerting pressure on the bead. The downward force of this semi-toroidal spring is relatively insensitive to tightening torque, because the toroidal groove opens up or "unrolls" as more torque is applied. Over the relatively small amounts of deflection involved here (the gap heights are preferably of the order of 0 to 0.07 inch), the fact that a gap is present may itself be a useful indicator, apart from actual gap height: the fact of lip deflection, not just its amount, indicates downward force. Increased gap height (in comparison to height before tightening) is a reliable indication that sealing force is being applied. As the closure is further tightened, the lip progressively deflects upwardly and inwardly, and the width of gap 56 increases, but without significantly changing the magnitude of the downward sealing force, because the spring force of the lip is relatively constant of its deflection.

It is desirable to limit rotation of the closure to a predetermined position which is determined by the point at which the stops 28, 34 abut (see FIG. 3). This limits the maximum torque applied. Together with the semi-toroidal lip, this provides a positive and known pressure on the seal which is largely independent of application torque, temperate, expansion, lubricity, and so on, and at the same time it provides a known or constant removal torque after the assembled container and closure have aged for a few days and the normal plastic creep or relaxation have occurred.

Ribs 50, if provided on the inner surface of lip 16, tend to stiffen the lip. In order to provide lip deflection at a desired sealing force, the lip can be made relatively thicker or thinner on the surface opposite the ribs, to provide the desired sealing force.

European patent application 87/116572.6 shows a composite closure wherein a plastic ring has a downturned lip that acts as a downwardly opening C-clamp. A plastic disk has a raised annular bead which is gripped and squeezed by the C-clamp lip of the ring; the clamp holds the plastic bead of the disk to form a side seal with the rim of the container. In contrast to the type of clamping action described in that European patent application, here the metal disk provides the clamping force and the toroidal lip is made thin enough to deflect; deflection of the lip is possible since the lip does not provide the clamping force. The lip deflects much more than the metal disk; and it primarily exerts a downward, or downward and outward, sealing force rather than a pinching or C-clamp action on the bead.

Insert disk 17 snaps into the ring and is retained by a bead or disk-retaining snap edge 26. The disk is preferably axially movable between snap edge 26 and the lip. Because the disk 17 is rotatable in the shell 14, when the closure 12 is unscrewed the closure can turn on the container while the disk is held stationary by frictional engagement with the rim 20. The closure shell 14 can move upwardly relatively to the disk 17 until the disk retaining edge 26 abuts the lower edge of disk wall 43; thereafter it lifts the disk, breaks the seal, and permits air to enter the container.

Turning next to the ratchet means, as indicated above it is preferred to provide a tamper-indicating band 36 which separates upon initial opening of the closure, to provide visual indication that the closure has been at least partially opened. In order to assure that the tamper-indicating band 36 is ruptured promptly, after just a small degree of rotation, it is further desirable to provide the ratchet interlock between the tamper-indicating band and the container 11, so that the tamper-indicating band is essentially prevented from following any rotation of the closure.

The tamper-indicating band 36 is formed as a downward extension of closure skirt 30, but is detachable or frangibly attached to it by a line of weakness, formed for example by a series of cuts separated by interim bridges 58, as is known in the art. (The bridges can for example be 0.005" to 0.030" wide×0.040" thick.) Along its lower edge band 36 has a band retainer **36*a* which comprises a plurality of hinged angularly spaced tabs or spring fingers, designated individually by 37 (see FIGS. 2 and 4). Each finger 37 is hinged to the band and presents one or more ratchets 63 (in the embodiment shown each finger has two ratchets 63). Alternate adjacent fingers are separated from one another by slots or gaps 62 which extend to the lower edge of band 36 (see FIG. 4). The fingers 37 are individually so stiff that if they were not separated by the gaps 62, they could not as a practical matter be inverted from the down "as molded" position (FIG. 4) to the inverted up "use" position in which they are folded upwardly from the band (FIGS. 2 and 3). In the embodiment shown, a gap 62 is provided between pairs of fingers 37, that is, two fingers-gap-two fingers-gap, and so on. Alternate pairs of fingers are connected by a web 67 at the outer ends of the fingers. (The webs may for example be about 0.014" thick×0.075" high.) An opening 68 is formed between each web 67 and the lower edge of band 36**.

When the closure 12 is being secured, the hinged connection of the ratchet fingers 37 to the band 36 provides a spring bias on the fingers, urging them inwardly toward the container. The fingers yield outwardly to pass over the respective cam 27 (FIG. 2) which guides them to seat with the ratchet sets 23 (FIG. 3).

Figure 5:
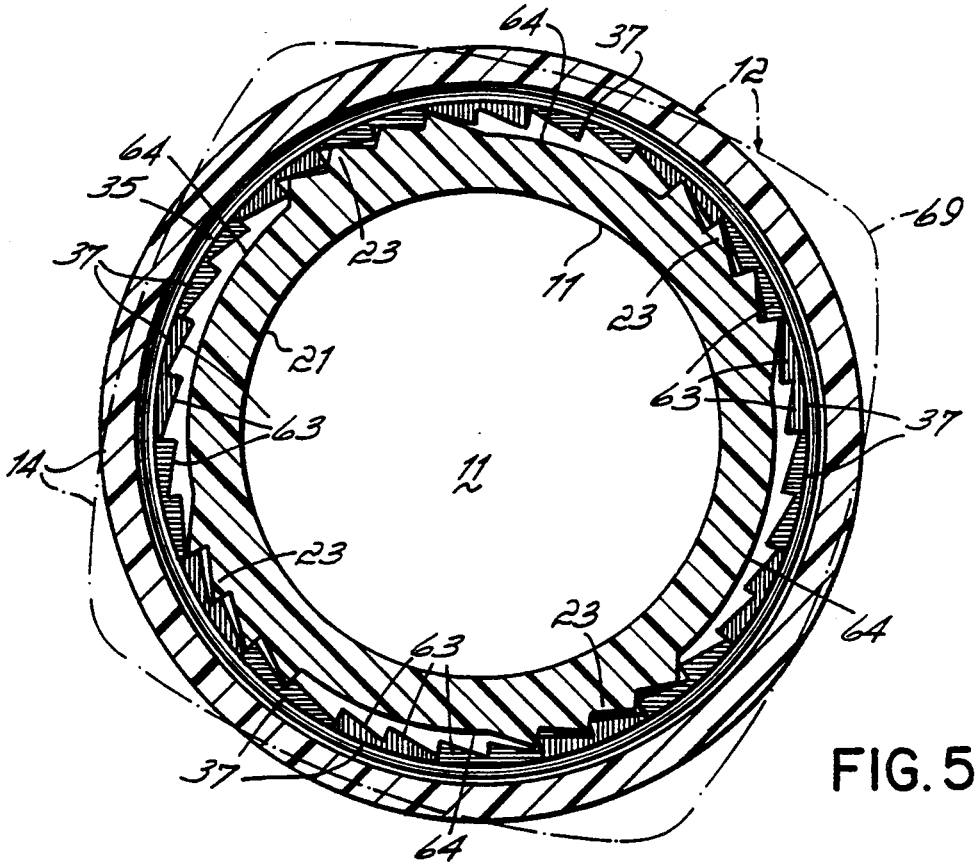
FIG. 5 is an enlarged cross-sectional view of the sealed package, taken on line 5—5 of FIG. 1.

As shown in FIGS. 4 and 5, the ratchets 63 on the closure are spaced substantially uniformly around the closure, whereas the ratchets 23 on the container are arranged in preferably four equally spaced groups, centered about 90° apart, with spaces 64 between them. The angular width of each space 64 is preferably at least 35°, and the spaces are preferably unequal in width (see FIG. 5). The angular width of each space is preferably no less than that of a group of ratchets. Because of these spaces only some of the closure ratchets 63 will be engaged with container ratchets 23; in the areas opposite the spaces 64 the closure ratchets are not engaged.

In the past, substantially all of the closure ratchets 63 were engaged with ratchets 23 on the container, and the bridges 58 all broke essentially simultaneously. Because they all broke at once, the total torque required to break them was the sum of their individual breaking torques. In order to keep the total torque required for bridge breaking sufficiently low for a user who might be an older person or arthritic and unable to exert a strong twist), the individual bridges had to be made relatively weak. Such engineered weakness of the bridges in turn sometimes caused inadvertent breakage during closure application. If, for example, a closure was applied slightly cocked or askew, or did not engage properly, some bridges might break prematurely, resulting in a reject.

It has now been found that the provision of the spaces 64 between the groups of ratchets on the container has a surprising effect on the manner in which the bridges break. The spaces 64 cause the bridges to break sequentially rather than simultaneously. Less force acts on the later breaking bridges, and they do not break at the same time as the first bridges to break. It is believed that this time delay occurs because the spaces 64 permit the band 36 and the attached retainer **36*a* to distort as they are torqued from their normal generally circular configuration to a more polygonal configuration, which in turn applies the shear stress unequally and causes some bridges to break sooner than others. More specifically, the closure ratchets 63 which are engaged with container ratchets 23 are held against rotation, but those which overlie the ratchet group spaces 64 are not gripped; and the tension tends slightly to distort the tamper evidencing band 36 across the gaps 50 by flattening its normal circular shape. This distortion is shown in FIG. 5 by the dotted line 69, in highly exaggerated form. The distortion, though actually slight, forms corners or relatively sharper bends in the band 36 adjacent the ends of the groups of container ratchets 23. The shearing stress on the bridges 58 is unequal around the circumference of the distorted band, and the bridges closest to the spaces break first. Bridge breaking then progresses sequentially to other bridges 58, including those which are closer to the spaces 64**. It is the rotation which shears the bridges, not any axial hold down force on the fingers.

It should be noted that the angular positions of the bridges with respect to the ratchets on the container is not generally predeterminable, as a practical matter. The bridges 58 are typically formed with a slitting wheel which cuts a slit through the shell, then skips over an area which remain as a bridge, then slices through again. The positions of the bridges are thus not correlated to the ratchets or threads on the closure, nor to the container ratchets.

Because the bridges break sequentially, the total breaking force required at any given moment is not the sum of the forces required to break a few bridges, but rather only that required to break a few bridges. Since that force is distributed among fewer bridges, all the bridges can be made relatively stronger while required force still remains desirably low. This reduces the incidence of premature bridge breaking. After the bridges break, the band 36 drops from the upper part of the shell. The band preferably remains on the bottle finish, below the thread. As the ring is turned it moves farther upwardly on the container and rib 26 lifts the disk and breaks the seal.

It can be seen in FIG. 5 that because the ratchets 23 and 63 on both the closure and the container are typically formed in split molds (which split on a centerline to open), the ratchets do not all have the same cross sectional shape. In order to make allowance for withdrawal of split mold sections from the ratchets, some ratchets cannot have an undercut face, only a slanting face. All the ratchets thus do not necessarily grip effectively, and as a result there is a tendency for ratchet fingers that are most strongly engaged to tip sideways and slip. Such slippage allows the closure ratchets to slide over the container ratchets without rupturing the bridges. However, it has been found that by providing the connecting webs 67 between the outer portions of several fingers, the fingers are made sufficiently stiff that they do not twist or cock circumferentially, and this problem is overcome. The gaps 62, 68 between the fingers provide exit slots for drying air blown through the interthread space.

It should be noted that while the sealing force indicating feature and the ratchet feature are preferably used together, they can be used separately. Where only the ratchet feature is to be used, the lip need not be configured to unwind significantly and the insert disk can be plastic or composite insert disk, as well as metal.

Having described the invention, those skilled in the art will understand from the foregoing description that the invention can be used in other embodiments within the scope of the following claims.

We claim:

1. A package comprising the combination of a container and a composite closure on said container, said closure including a molded plastic ring and a separately formed metal disk inserted in said ring, said disk having a center portion and an annular raised bead around said center portion, said bead having a top and presenting a downwardly opening groove containing a gasket which is sealingly engageable with a rim of said container, said ring having a skirt with securing means which are engageable with cooperating means on said container, said ring having an inwardly extending semi-toroidal annular lip, said lip curving downwardly and inwardly over said bead to a lower inner edge, said lip having an undersurface which adjacent said lower inner edge is spaced radially inwardly from said bead, said lip bearing on said bead at substantially the top of the bead to exert downward force on said bead at least when said container is being sealed and not exerting radial clamping force across said bead, said lower edge being spaced by a visible vertical gap above said center portion of said disk when said disk forms a seal with said container, force in reaction to downward force exerted by said lip on the top of said bead bending said lip upwardly as a torsion spring and thereby increasing the height of said gap sufficiently that said height provides a visible indicator that said lip has exerted sealing force on the disk.

2. A package comprising the combination of a container and a composite closure on said container, said closure including a molded plastic ring and a separately formed metal disk inserted in said ring, said disk having a center portion and an annular raised bead around said center portion, said bead having a top and presenting a downwardly opening groove containing a gasket which is sealingly engageable with a rim of said container, said ring having a skirt with securing means which are engageable with cooperating means on said container, said ring having an inwardly extending semi-toroidal annular lip, said lip engaging and curving downwardly and inwardly over said bead, said lip exerting downward force on the bead at the top thereof at least when said container is being sealed, said lip having a lower inner edge which is spaced by a visible annular gap above said center portion of said disk when said disk forms a seal with said container, said lip having an undersurface which is spaced radially inwardly from said bead adjacent said lower inner edge, said lip exerting downward force rather than radial clamping force on said bead, force in reaction to downward force exerted by said lip on the top of said bead bending said lip upwardly as a torsion spring and thereby increasing the height of said gap sufficiently that said height provides a visible indicator that said lip is exerting sealing force on the disk, said lower inner edge of said lip bearing upon said center portion of said disk when said closure is not sealed on said container and being spaced upwardly from said center portion when said closure is sealing said container.

3. The package of claim 1 wherein said lip has spaced channels on said undersurface thereof which channels extend across said top of said bead, said lip bearing on the top of said bead between said channels, said channels leading into an interthread space between said closure and said container.

4. The package of claim 1 wherein said bead comprises an inside wall, an outside wall and a top connecting said walls, downward force of said lip on said bead pressing said walls against said rim to form a seal therewith.

5. The package of claim 1 wherein said lower inner edge of said lip moves resiliently upwardly and inwardly from said bead as said closure is being sealed.

6. The package of claim 1 wherein said securing means are threads.

7. The package of claim 1 wherein said securing means is a single continuous thread.

8. The package of claim 7 wherein said single continuous thread has a flat surface for engaging a cooperating thread.

9. The package of claim 1 wherein stops are provided on said ring and on said container which limit the rotation thereof.

10. The package of claim 1 further including tamper-evidencing means.

11. The package of claim 10 wherein said tamper-evidencing means includes ratchets which restrict opening of said closure.

12. The package of claim 1 wherein said lip is of substantially uniform thickness between said inner edge and said skirt.

13. The package of claim 1 wherein said disk is retained in said ring by an inwardly extending boss on said skirt.

14. The package of claim 1 wherein said lip has an undersurface with an apex which bears on said top of said bead.

15. A package comprising a container and a composite closure on said container, said closure including a molded plastic ring and a separately formed disk housed in said ring, said ring having a skirt with rotational securing means which engage cooperating means on said container, said ring having a tamper-evidencing band which is connected to said skirt by frangible bridges, a retainer extending upwardly and inwardly toward said container from said band, said retainer and said container having interengaging ratchets which resist rotation of said retainer in a direction tending to open said closure, the ratchets on said retainer extending substantially entirely around said retainer, ratchets on said container being in groups of ratchets which groups are separated angularly from one another by circumferential spaces, said band being radially deformable when said closure is twisted for initial removal so that portions of said band opposite said spaces deflect inwardly toward said spaces when said closure is being removed and thereby break said bridges in groups rather than simultaneously.

16. The package of claim 15 wherein said groups of ratchets are angularly spaced on said container by at least 35 degrees.

17. The package of claim 15 wherein said spaces are not all equal in angular width.

18. The package of claim 15 wherein the angular width of said spaces is at least equal to the angular width of said groups of ratchets.

19. The package of claim 15 wherein each said group contains multiple ratchets.

20. The package of claim 15 wherein said ratchets on said retainer are formed on spring fingers.

21. The package of claim 15 further including a cam on said container above said groups of ratchets to cam ratchets on said retainer into engagement with the ratchets of said groups.

22. The package of claim 21 wherein said cam is provided only above the respective groups of ratchets on said container.

23. The package of claim 21 wherein said cam is angled downwardly and outwardly, then downwardly and obliquely inwardly toward said groups of ratchets on said container.

24. A package comprising a container and a composite closure on said container, said closure including a molded plastic ring and a separately formed disk housed in said ring, said ring having a skirt with rotational securing means which engage cooperating means on said container, said ring having a tamper-evidencing band which is connected to said skirt by frangible bridges, a retainer extending upwardly and inwardly toward said container from said band, said retainer and said container having interengaging ratchets which resist rotation of said retainer in a direction tending to open said closure, the ratchets on said retainer extending substantially entirely around said retainer, the ratchets on said container being in groups of ratchets which groups are separated angularly from one another by circumferential spaces, portions of said band opposite said spaces deflecting inwardly toward said spaces when said closure is being opened thereby breaking said bridges sequentially rather than simultaneously, said bridges being non-uniformly positioned with respect to said ratchets on said retainer.

25. The package of claim 24 wherein said fingers extend from and are folded from said band.

26. A package comprising a container and a composite closure on said container, said closure including a molded plastic ring and a separately formed disk housed in said ring, said ring having a skirt with rotational securing means which engage cooperating means on said container, said ring having a tamper-evidencing band which is connected to said skirt by frangible bridges, a retainer extending upwardly and inwardly toward said container from said band, said retainer and said container having interengaging ratchets which resist rotation of said retainer in a direction tending to open said closure, the ratchets on said retainer extending substantially entirely around said retainer, the ratchets on said container being in groups of ratchets which groups are separated angularly from one another by circumferential spaces, portions of said band opposite said spaces deflecting inwardly toward said spaces when said closure is opened thereby breaking said bridges sequentially rather than simultaneously, the ratchets on said container having different cross sections as viewed in a plane perpendicular to a central axis of said container whereby said ratchets can be removed from a split mold.

27. The package of claim 26 wherein the container has four such groups of ratchets, centered about 90 degrees apart.

28. The package of claim 15 wherein said bridges are non-uniformly positioned with respect to said ratchets on said retainer.

* * * * *